US005230683A

United States Patent [19]

Van Der Hoeven

[11] Patent Number: 5,230,683

[45] Date of Patent: * Jul. 27, 1993

[54] MULTI-FUNCTIONAL EXERCISING APPARATUS

[76] Inventor: Martin A. Van Der Hoeven, 3330 Carlsbad Blvd. #303, Carlsbad, Calif. 92008

[ * ] Notice: The portion of the term of this patent subsequent to Apr. 7, 2009 has been disclaimed.

[21] Appl. No.: 830,650

[22] Filed: Feb. 4, 1992

Related U.S. Application Data

[63] Continuation-in-part of Ser. No. 703,012, Mar. 20, 1991, Pat. No. 5,102,125, and Ser. No. 790,881, Nov. 12, 1991, Pat. No. 5,160,304, which is a continuation-in-part of Ser. No. 603,454, Oct. 25, 1990, Pat. No. 5,085,429, and Ser. No. 395,537, Aug. 18, 1989, Pat. No. 5,005,832, and Ser. No. 360,133, Jun. 1, 1989, Pat. No. 4,966,363, which is a continuation-in-part of Ser. No. 156,404, Feb. 16, 1988, Pat. No. 4,848,740.

[51] Int. Cl.[5] ..... A63B 21/05

[52] U.S. Cl. ..... 482/128; 482/47

[58] Field of Search ..... 482/44, 47, 48, 112, 482/113, 121-130, 139, 148; 128/26

[56] References Cited

U.S. PATENT DOCUMENTS

| | | | |
|---|---|---|---|
| 1,548,849 | 8/1925 | Ruden | 482/128 |
| 2,118,684 | 5/1938 | Prescott | 482/48 X |
| 2,634,976 | 4/1953 | Mock | 482/48 |
| 3,447,415 | 6/1969 | Kime | 482/47 X |
| 3,738,651 | 6/1973 | Norman et al. | 482/47 |
| 3,746,339 | 7/1973 | Cox | 482/126 |
| 4,466,613 | 8/1984 | Reese | 482/123 |
| 4,678,181 | 7/1987 | Ditsch et al. | 482/128 X |
| 5,102,125 | 4/1992 | Van Der Hoeven | 482/121 X |

FOREIGN PATENT DOCUMENTS

| | | | |
|---|---|---|---|
| 650407 | 7/1985 | Switzerland | 482/113 |
| 1289516 | 2/1987 | U.S.S.R. | 482/121 |
| 456223 | 11/1936 | United Kingdom | 482/128 |

*Primary Examiner*—Robert Bahr

*Attorney, Agent, or Firm*—Henri J. A. Charmasson

[57] ABSTRACT

A multi-functional apparatus for the development or rehabilitation of the entire human musculature is packaged in a compact and lightweight housing. It combines three sets of exercising arms which can be biased against either pushing or pulling movements. The first set has parallel arms working in a front/back horizontal direction. The second set offers incline, back-to-back arms operating in sideways, horizontal direction. The third set features a pair of parallel arms moving in a vertical direction. Each arm can be operated with a hand or a foot. Each exercising arm is part of a removable arm assembly that can be used separately from the apparatus in combination with various attachments as a portable musculature development exerciser.

9 Claims, 3 Drawing Sheets

MULTI-FUNCTIONAL EXERCISING APPARATUS

PRIOR APPLICATION

This application is a continuation-in-part of co-pending Ser. No. 07/703,012, filed Mar. 20, 1991, now U.S. Pat. No. 5,102,125, and Ser. No. 790,881 filed Nov. 12, 1991, now U.S. Pat. No. 5,160,304 both continuations-in-part of co-pending Ser. No. 07/603,454, filed Oct. 25, 1990, now U.S. Pat. No. 5,035,429 a continuation-in-part of applications Ser. No. 07/395,537 filed Aug. 18, 1989, now U.S. Pat. No. 5,005,832 and of Ser. No. 07/360,133 filed Jun. 1, 1989, now U.S. Pat. No. 4,966,363 which was a continuation-in-part of Ser. No. 07/156,404 filed Feb. 16, 1988, now U.S. Pat. No. 4,848,740.

FIELD OF THE INVENTION

This invention relates to the field of athletic equipment used for muscle development or rehabilitation and more particularly this invention relates to multi-functional exercise devices for home use.

BACKGROUND OF THE INVENTION

The ever increasing popular field of body development and exercise activity has spurred the introduction of varied exercise apparatuses. Some of those apparatuses such as a climber are intended to exercise the cardio-vascular system or to develop a particular section of the human musculature such as the leg muscles. Others combine in a rack of plurality of devices which can be separately used to rehabilitate or develop specific parts of the musculature. The combined devices sometimes share a common weight stack through pulleys and cables in order to reduce the size and weight of the installation. These attempts at lightening and reducing the size of the machinery fall short of providing a comprehensive set of exercisers which can be had at a reasonable price, and which does not require extensive surface areas while in use or in storage. Furthermore, none of the prior devices can provide for a wide range of exercises or even include a recumbent cardio-vascular system exerciser.

SUMMARY OF THE INVENTION

The principal and secondary objects of this invention are to provide a multi-functional and versatile anaerobic and aerobic exercising apparatus which can be used to rehabilitate or develop a large number of elements of the human musculature and improve the cardio-vascular system, to replace a large number of cumbersome and expensive separate exercising machines, each dedicated to the exercise and development of a particular set of muscles; and to drastically reduce the working and storage space requirements for comprehensive anaerobic and aerobic equipment.

These and other objects are achieved by means of a compact and light-weight apparatus which consists essentially of a housing from which a first pair of resiliently biased arms project out of a front wall, a second pair of resiliently biased arms project in opposite directions from side walls, and a third pair of resiliently biased arms project in a parallel and upward direction from the top. Each arm terminates in a hand assembly comprising a push-plate and a handle extending in a right-angled configuration from the push-plate. Carriage having a upper surface shaped and dimensioned to receive the heels of the operator run along tracks under each of the first and second pair of arms. The apparatus is light enough to be held off the ground for some exercises. For most exercises the apparatus need only to be laid against a wall. For some pulling exercises it is necessary that the apparatus be anchored to the floor, a wall or a table top. In an alternate embodiment of the invention, each of a pair of exercising arms is packaged in a removable sheath cassette. Each arm assembly can be used separately from the apparatus to perform a variety of exercises.

The apparatus may be used to perform the following body exercises:

1) While laying on his back with the head toward the apparatus, the operator, by grabbing the handles at the end of the first pair of arms and pushing against the resilient bias of the arms, can exercise triceps and deltoids.

2) While in a sitting or standing position, the operator may grab the handles at the end of the first pair of arms and push to develop triceps and serratus anterior.

3) Laying back or relaxing with legs toward the apparatus, placing his heels in the carriage associated with the first pair of arms and pushing against the plates, the operator will exercise his quadriceps and glutaeus maximus.

4) In the same position, alternate pressing movements of the legs at progressively increased speed constitutes an aerobic exercise.

5) While laying on his back with legs toward the apparatus, the heels resting on the stationary carriages and pushing with the forefoot against the push plate of the first set of arms, the operator will exercise his gastrocnemius with the knees extended, and the soleus with the knees bent.

6) By placing the plate associated with the first pair of arms against his abdomen, then grabbing the handles associated with the second pair of arms, and pulling the entire apparatus toward him, the operator can perform exercises beneficial to the latissimus dorsi and biceps with palms up, and the brachialis with palms down, as well as the rectus abdominis through isometric contractions of the abdominal musculature.

7) Sitting or laying on his back with both heels resting on the carriages associated with the lateral arms, and pushing with the inner side of each foot against the pushplates will develop adductors.

8) Pushing in the opposite direction, that is with the outer side of the foot against handles constitutes an exercise for the development of abductors, glutaeus medius and tensor fasciae latae.

9) When the first of the last two exercises is practiced with hands and arm, the inward pushing movement develops the pectoralis major.

10) The second pulling exercise done with hands and arms favors the scapular muscles, the posterior deltoid, the middle trapezius and the triceps.

11) Using the vertical arms in a standing or sitting position, and pushing down with one or both hands on the handles will exercise the triceps and latissimus dorsi whether the exercise is performed with elbows bent or extended.

12) Hamstrings may be exercised by sitting and pressing with each foot against the push plates.

The following described exercise requires that the apparatus be anchored to the floor, to wall or a work surface.

13) While laying back, with head toward the device, the operator can pull on the first set of arms to develop his biceps and latissimus dorsi.

14) The same pulling exercise can also be practiced in a sitting position, palms up.

15) If the exercise is palm down, the brachialis will be exercised along with the latissimus dorsi.

16) Laying on his back with legs toward the device and heels on the carriages associated with the first set arms, and the forefoot inserted between the push plate and handles will develop the hamstrings, iliacus and psoas major.

17) The same exercise with heel kept stationary while pulling with the forefoot will favor the ankle dorsiflexors.

18) Another biceps exercise can be practiced in a sitting or standing position by lifting the third pair of arms with elbows bent and arms up.

19) The same exercise will, with palms down, favor the brachialis.

The same exercise practiced with arms outstretched will help develop anterior deltoids.

20) From a sitting position, the operator can place his forefoot between the push plate and handle of the third pair of arms and pull them upward alternately by lifting his legs to develop abdominals, psoas major and iliacus.

DESCRIPTION OF THE PREFERRED EMBODIMENT OF THE INVENTION

Figure 1:
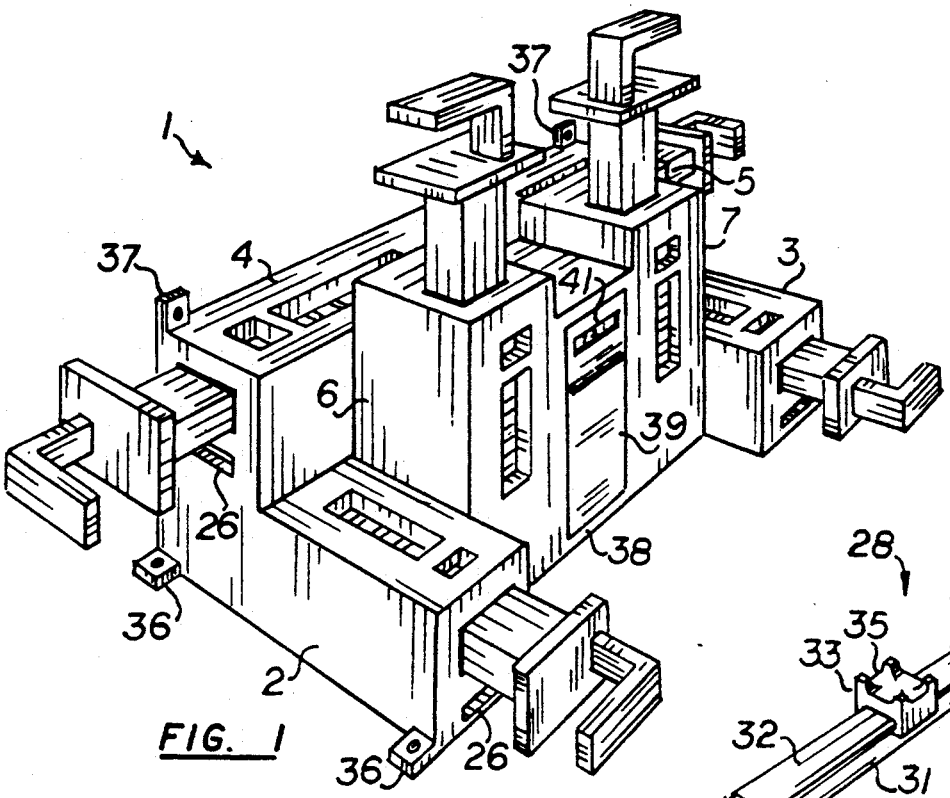
FIG. 1 is a perspective view of the multi-functional exercising apparatus.
Figure 4:
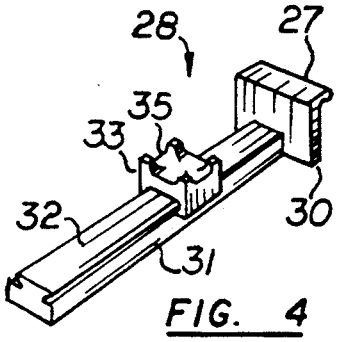
FIG. 4 is a perspective view of a heel carriage and slide assembly.
Figure 2:
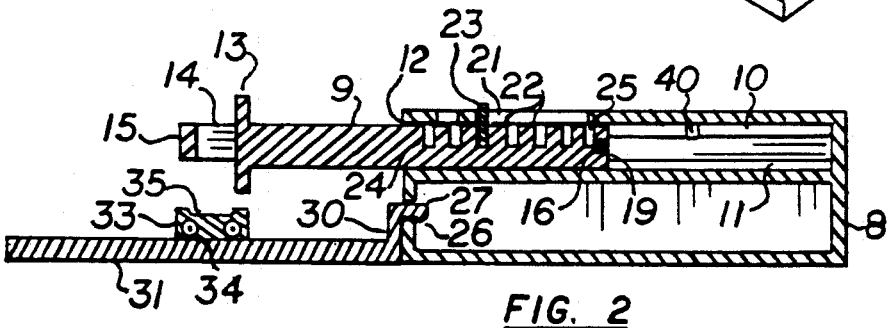
FIG. 2 is a vertical, median cross-sectional view of an arm assembly.
Figure 3:
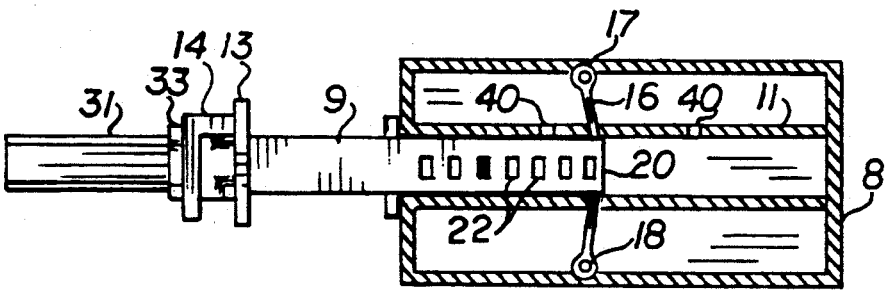
FIG. 3 is a median, horizontal, cross-sectional view thereof.

Referring now to the drawing, FIG. 1 illustrates a complete exercising apparatus 1 which consists essentially of a combination of six identical assemblies 2, 3, 4, 5, 6, and 7 arranged into three sets; each operating along one of three orthogonal directions. The first pair of assemblies 2, 3 are laid in a parallel configuration in a front to back direction. The second pair of assemblies 4, 5 are arranged in a back to back in line configuration along a left/right axis, and above the planes occupied by the first pair 2, 3. The third pair of assemblies 6, 7 are arranged in a side by side parallel configuration in a vertical direction. The internal configuration of each assembly is illustrated in FIGS. 2 and 3. Each assembly comprises a housing 8 which is integral with the housing of the adjacent assemblies. A sliding arm 9 runs between two parallel tracks 10, 11 within the housing and extends outside the housing through an opening 12. The distal or upward end of the arm 9 is terminated by a push-plate 13 from which extends a L-shaped member 14 forming a handle 15 perpendicular to the axis of the sliding arm 9. An elastic cord 16 stretched between two anchor points 17, 18 inside the housing 8 on opposite sides of the tracks 10, 11 passes through a transversal bore 19 near the internal or proximal end 20 of the arm 9. A slot window 21 cuts into the upper track 10 and roof of the housing 8 gives access to a series of pegholes 22 in the top inner half of the sliding arm 9. A peg 23 inserted through the window 21 into one of the arm holes 22 is used to preset a certain amount of tension of the arm 9 against the elastic cord 16 in either direction. In other words, the position of the peg 23 determines whether the elastic cord 16 applies a resilient bias against penetration of the arm 9 into the housing, or a resilient bias against extraction of the arm 9 out of the housing. For instance, placing the peg in the outermost hole 24 will tension the arm against penetration into the housing. Placing the peg in the innermost hole 25 will tension the arm against any extracting movement. The housings of the first and second pairs of assemblies 2, 3, 4, and 5 have a slot opening 26 located immediately under the arm opening 12. This slot is sized and dimensioned to be engaged by the connecting nib 27 of a carriage assembly 28 shown in perspective in FIG. 4. The nib 27 has a slightly enlarged head which snaps into the slot to positively lock the carriage assembly 28 against the face of the housing. The nib 27 extends from a positioning plate, and a track 31 projects orthogonally from the plate immediately under the traveling space of the handle 15 and push-plate 13 assembly. The track 31 has a dovetail rail 32 which is engaged by, and upon which run, a carriage 33. The carriage 33 has internal rollers 34 bearing against the rail 32, and a concavely arcuate top surface 35 which is shaped and dimensioned to support a human heel whether the leg is perpendicular or orthogonal to the sliding movement of the arm 9 and associated carriage 33. Four anchoring brackets 36 are provided around the base of the apparatus and two anchoring brackets 37 are provided along the upper back edge.

In a seventh housing 38 located between the third pair of assemblies 6, 7 is installed a sound-reproducing machine 39 which is used to play sets of coaching instructions and pace-setting music from sound recordings. The various segments of the coaching program may be started and synchronized by electrical signals derived from switches 40 located along the tracks of each arm assembly. The number of switch activations are totalized and displayed on a readout 41.

Figure 5:
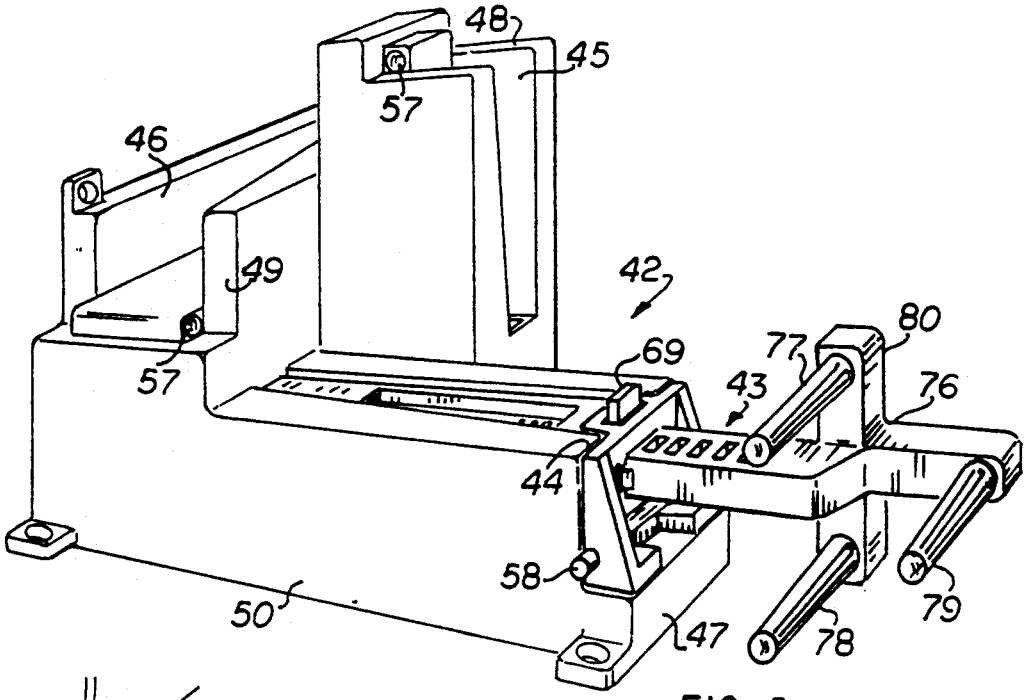
FIG. 5 is a partial perspective view of an alternate embodiment of the invention.
Figure 8:
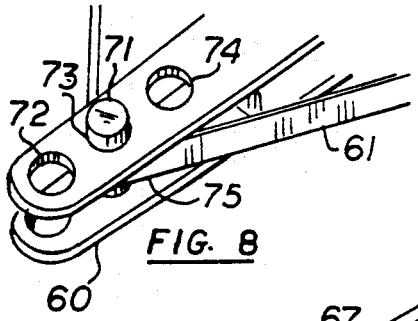
FIG. 8 is a perspective view of the inner end portion of the exercising arm.
Figure 6:
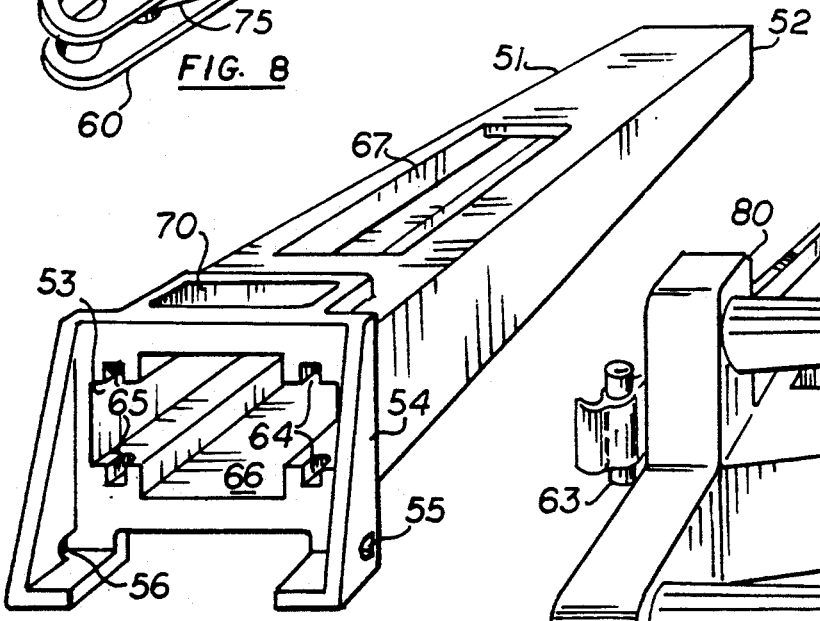
FIG. 6 is a perspective view of the removable mounting sheath.
Figure 7:
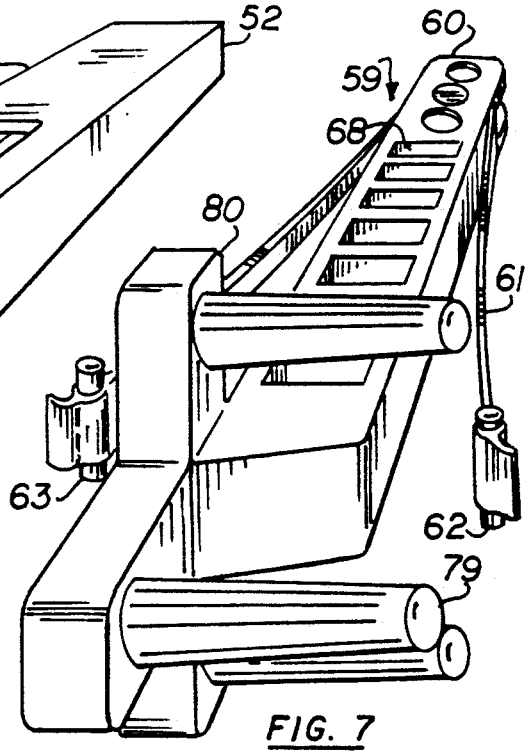
FIG. 7 is a perspective view of the exercising arm.
Figure 9:
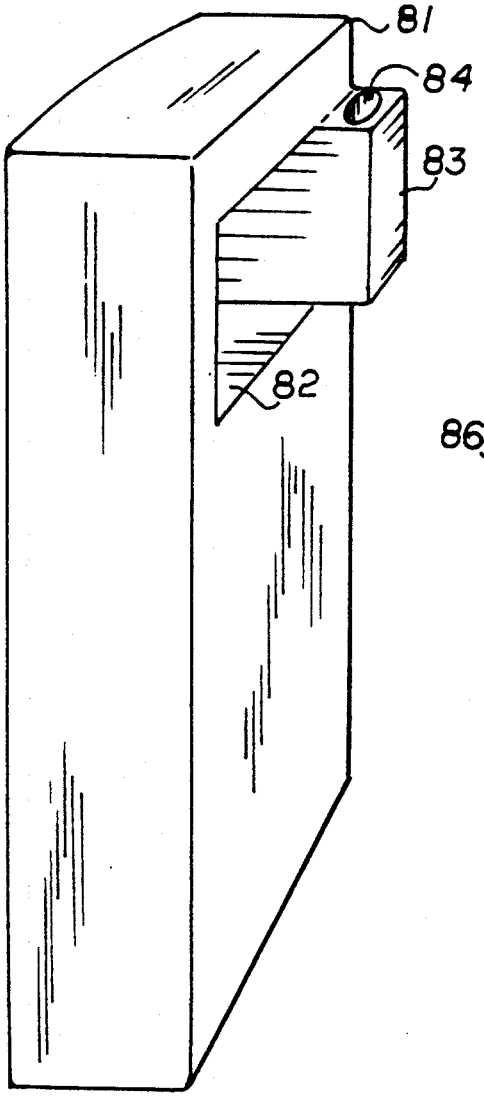
FIG. 9 is a perspective view of a first handle attachable to the median portion of the arm assembly.
Figure 10:
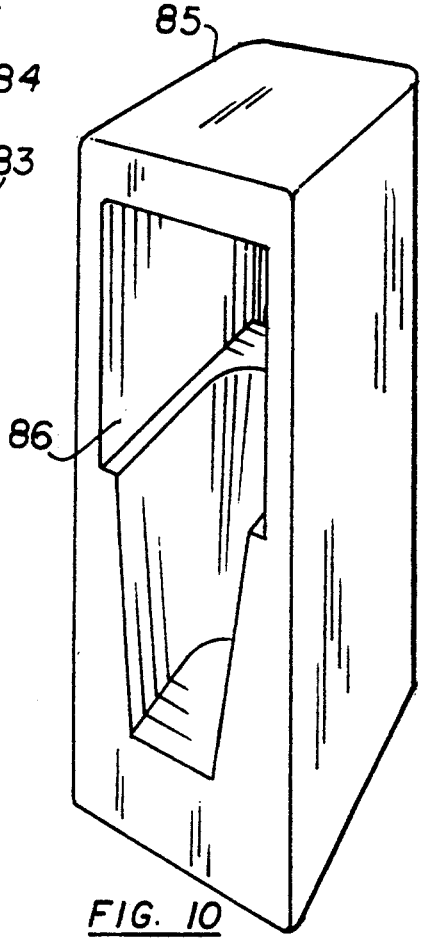
FIG. 10 is a perspective view of a moving arm end attachment.
Figure 12:
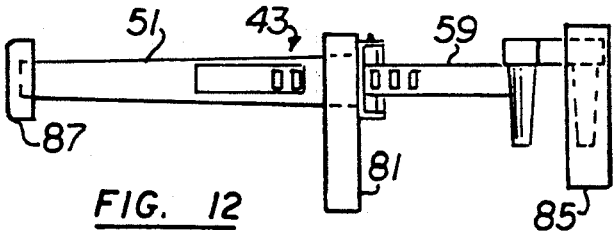
FIG. 12 is a side view of the arm assembly with three attachments affixed thereto.
Figure 11:
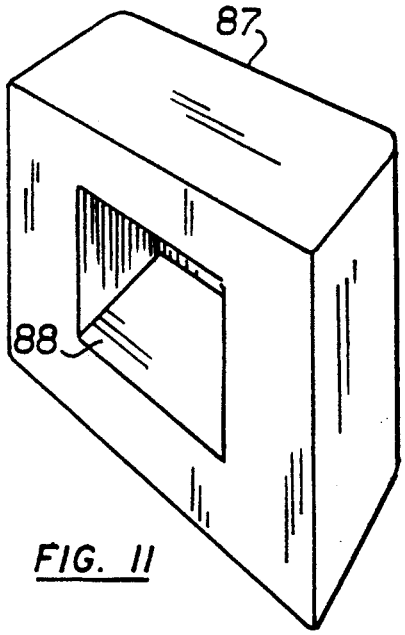
FIG. 11 is a perspective view of a sheath base attachment.

An alternate embodiment 42 of the exercising apparatus 1 is a single pair of exercising arm assemblies 43 of which one only is illustrated in FIG. 5. Each pair of exercising arm assemblies 43 can be inserted into one of the three pairs of parallel channels or cavities 44, 45, 46 opening into the front face 47, top 48 and sides 49 respectively of the housing 50. Each exercising arm assembly comprises a sheath 51 having a closed inner end 52 and an opening 53 at the outer end that is surrounded by a flanged rim 54. The flanged rim 54 is shaped and dimensioned to bear against the rims of the housing cavities. The channels or cavities 44, 45, 46 have a backward tapering shape that closely matches the outline of the sheath and facilitates its placement therein. A pair of holes 55, 56 in the flanged rim line up with a bore 57 drilled transversally through the lower part of each cavity rim. A pin 58 passed through said holes 55 and bore 57 secures the sheath 51 into one of the cavities. A movable arm 59 is inserted through the opening 53 into the sheath 51. The inner end 60 of the arm captures an elastic band 61. Small cylindrical stops 62, 63 held into loops at the extremities of the band 61 nest into two pairs of slots 64, 65 astride the arm 59. The sheath inner channel 66 intimately matches the outside geometry of the exercising arm 59. A window 67 in the top section of the exercising arm gives access to the series of holes 68 in the top surface of the arm that receives the tension-setting pin 69 as in the first embodiment 1. A single pin window 70 just behind the rim 54 of the sheath also receives the pin 69 for locking the arm in its farthermost penetrating position for storage or transportation. A pin 71 insertable in a series of holes 72, 73, 74 at the inner end of the arm 60 serves as a bearing surface for the median section 75 of the band 61. Thus providing additional tensioning adjustment for the apparatus. The exercising arm 59 has a cross-like structure 76 at its outer end. Handles 77, 78, 79 parallel to one another project orthogonally from the tips of the cross-members. This arrangement provides for a variety of handling positions of the exercising arm by the hand or foot of the user. For example, the user may grab either one of the innermost handles 77 or 78 projecting from the cross-member 80 with the hand while the upper part of the wrist lies against the third handle 79. The flat of the foot may be laid against the innermost handles 77 and 78 with the dorsum bearing against handle 79. In this last configuration the innermost handles 77, 78 act as the pushplates 13 of the first embodiment of the invention. This versatile three-handle arrangement allows for a great variety of uses of the exercising arm assemblies either within the stationary apparatus 42 or without it. The shifted position of the cross-like handle-supporting structure 76 in relation to the axis of the arm 59 places the vector of the force applied to the handles by the user in line with said axis for better stability an smoother operation of the exercising arm assembly.

FIGS. 9–12 illustrate three attachments to the exercising arm assembly 43 for use outside the stationary apparatus 42.

The first attachment 81 is a cross-bar of a substantially oblong shape having a transversal channel 82 shaped and dimensioned to engage the sheath 51. It should be noted that the channel 82 has the same geometry as the channels 44, 45 and 46 of the stationary apparatus including a projection 83 with a transversal bore 84 for receiving the flanged rim locking pin 58. The second attachment 85 has also a general oblong shape, and features a longitudinal cavity 86 which is shaped and dimensioned to intimately nest the outermost part of the cross-like structure 76 and the outermost handle 79. The third attachment 87 is a substantially quadrangular pad with a central cavity 88 shaped and dimensioned to tightly nest the closed end 52 of the sheath. The three attachments provide convenient bearing surfaces to hold the exercising arm assembly 43 in a variety of stable positions. For example, in adductor developing exercises, the device may be squeezed between the knees bearing against the first and second attachments 81, 85. In an excise intended to develop abdominal muscles, the third attachment 87 may be applied against the plexus region while the subject pulls inwardly on the handles. Thus the use of these attachments further increases the versatility of the device.

The stationary apparatuses 1 and 42 can also be combined with a variety of other implements such as seats, benches, and recliners that would allow use of the combination to practice and even greater variety of exercises. For example, the housing 8, 50 may be secured to a chair or mounted on a recliner for sit-down or lay-back position exercises.

It should be noted that any resilient structure equivalent to the elastic bands 16, 61 could be used to oppose the sliding movement of the arms 9, 59 including, but not limited to, springs compressed fluid cylinders and air bellows.

While the preferred embodiments of the invention have been described, modifications can be made and other embodiments may be devised without departing from the spirit of the invention and the scope of the appended claims.

What is claimed is:

1. A portable device for exercising the musculature of a subject which comprises:

an elongated sheath having a closed end, and a flanged rim surrounding an aperature at an opposite end;

a rigid arm having an end portion movably inserted into said sheath through said aperture;

a resilient band having extremities secured to said flanged rim astride said arm, and a median section engaged by the end portion of said rigid arm, said band being dimensioned to resiliently oppose further insertion of the arm into the sheath;

means for adjustably setting a tensioned rest position of the arm within the sheath;

a handle associated with an opposite end section of the arm outside said sheath;

said means for adjustably setting comprise:

a window in a portion of the sheath; and a removable pin engaged through said window and through one of a plurality of bores along said arm.

2. The device of claim 1 in combination with a musculature exercising apparatus comprising:

a generally quadrangular housing having a top, bottom, two side walls, a front wall and a back wall;

at least one of said top, side walls and front wall having a cavity shaped and dimensioned to engage one of said sheaths; and means for securing the rim of one of said sheaths to said housing.

3. The device of claim 1, which further comprises means for holding said sheath in a variety of positions.

4. The device of claim 3, wherein said means for holding comprise:

an oblong, rigid cross-member having a transversal channel shaped and dimensioned to engage said sheath; and means for securing said sheath into said channel.

5. The device of claim 3, wherein said means for holding comprise an oblong, rigid end-member having a longitudinal cavity shaped and dimensioned to intimately engage said opposite end sections and said handle.

6. The device of claim 3, wherein said means for holding comprise a rigid base-member having a cavity shaped and dimensioned to intimately engage said closed end of the sheath.

7. The device of claim 6, wherein at least one of said top, side walls and front wall has a pair of side-by-side spaced apart cavities shaped, dimensioned and oriented to hold two of said sheaths in a parallel position; and means for securing said sheaths into said cavities.

8. A musculature exercising apparatus which comprises:

a generally quadrangular housing having a top, bottom, two side walls, a front wall and a back wall;

a first pair of removable arm assemblies;

means for holding said first pair of arm assemblies in a parallel orientation projecting in a first horizontal plane from the front wall;

each of said arm assemblies comprising:

an elongated sheath having a closed inner-end and an opening at an opposite outer-end;

an arm slidingly engaged into the opening of the sheath; and a resilient means for outwardly biasing the arm against forced penetration into the sheath;

said means for holding comprising:

the housing having a pair of spaced-apart cavities in the front wall;

said sheath having a flanged rim around the aperture, and means for securing said rim to the front wall;

a second pair of removable arm assemblies; and means for holding said second pair of arm assemblies in a substantially end-to-end orientation projecting in opposite directions outwardly from said side walls.

9. The apparatus of claim 8, which further comprises:

a third pair of removable arm assemblies; and means for holding said third pair of arm assemblies in a parallel orientation projecting upwardly in a vertical plane from the top of the housing.

* * * * *